US007011108B2

(12) United States Patent
Benckert et al.

(10) Patent No.: US 7,011,108 B2
(45) Date of Patent: Mar. 14, 2006

(54) DEVICE FOR ACTUATING AN ARTICULATED MAST, ESPECIALLY FOR CONCRETE PUMPS

(75) Inventors: Hartmut Benckert, Filderstadt (DE); Paul Von Bäumen, Sindelfingen (DE)

(73) Assignee: Putzmeister Aktiengesellschaft, (DE)

( * ) Notice: Subject to any disclaimer, the term of this patent is extended or adjusted under 35 U.S.C. 154(b) by 117 days.

(21) Appl. No.: 10/473,277

(22) PCT Filed: Feb. 22, 2002

(86) PCT No.: PCT/EP02/01877

§ 371 (c)(1),
(2), (4) Date: Sep. 30, 2003

(87) PCT Pub. No.: WO02/079596

PCT Pub. Date: Oct. 10, 2002

(65) Prior Publication Data

US 2004/0094212 A1 May 20, 2004

(30) Foreign Application Priority Data

Apr. 2, 2001 (DE) ..... 101 16 407

(51) Int. Cl.
*E04G 21/04* (2006.01)
*B66C 13/18* (2006.01)

(52) U.S. Cl. ..... 137/624.11; 137/615

(58) Field of Classification Search ..... 137/615, 137/624.11; 141/387, 388; 91/361, 363 R
See application file for complete search history.

(56) References Cited

U.S. PATENT DOCUMENTS

| | | | | |
|---|---|---|---|---|
| 5,640,850 | A | 6/1997 | Benckert et al. | |
| 5,640,996 | A * | 6/1997 | Schlecht et al. | 137/615 |
| 5,823,218 | A | 10/1998 | Schlecht et al. | |
| 6,883,532 | B1 * | 4/2005 | Rau | 137/615 |

FOREIGN PATENT DOCUMENTS

| | | |
|---|---|---|
| DE | 43 06 127 A1 | 9/1994 |
| DE | 43 30 137 A1 | 3/1995 |
| DE | 44 12 643 A1 | 3/1995 |
| DE | 195 20 166 A1 | 11/1995 |
| DE | 195 03 895 A1 | 8/1996 |
| GB | 2 106 756 A | 4/1983 |
| JP | 2000282687 | 3/1999 |

* cited by examiner

*Primary Examiner*—Kevin Lee
(74) *Attorney, Agent, or Firm*—Pendorf & Cutliff

(57) ABSTRACT

The invention relates to a device for monitoring the safety of an articulated mast (22), especially of a concrete distribution mast, whose mast segments (23 to 27) are controlled via a remote control (50) and a control device (62) that is responsive to the remote control signals using a computer-assisted circuit arrangement (80). Safety monitoring is made possible by the provision of an interrupter element (112, 112') in the control device (62) which disrupts, via a delay member (116), the connection to the control inputs of the actuators (92, 94) associated drive units and/or the feed units (98, 100) for the purpose of power or pressured oil feed once the remote control elements (52) of the remote control device (50) are in the off-position.

15 Claims, 2 Drawing Sheets

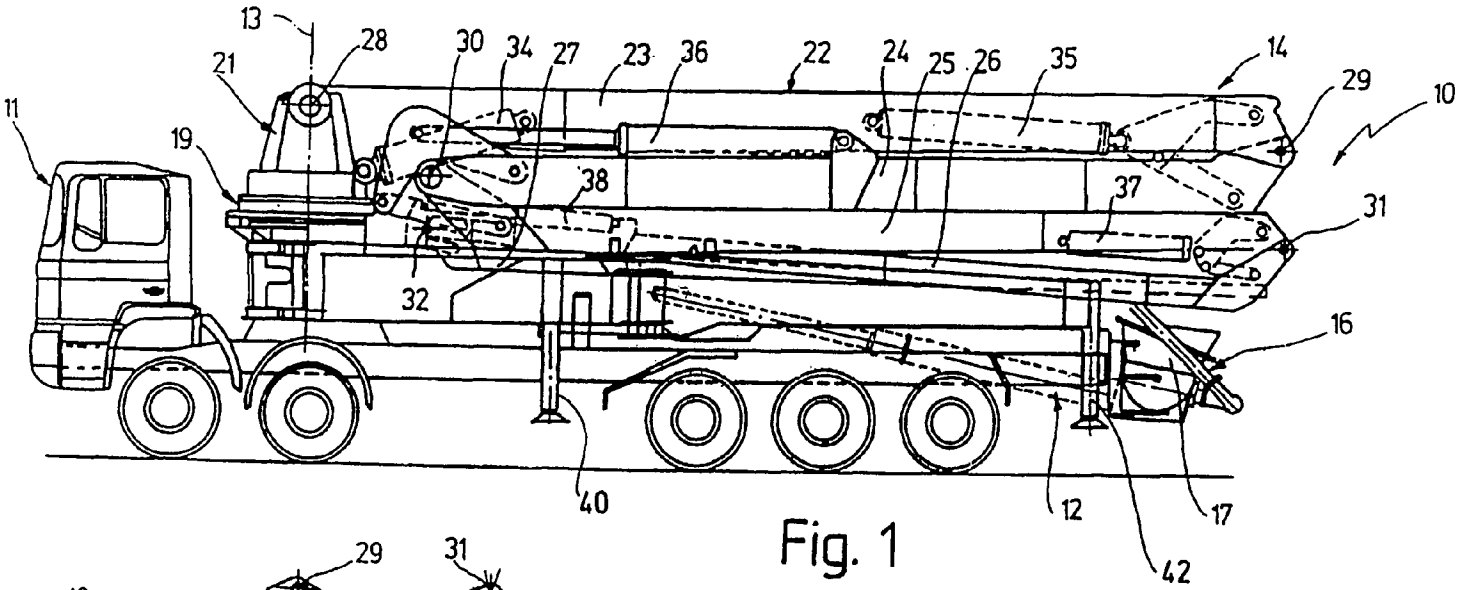
Fig. 1
Fig.2
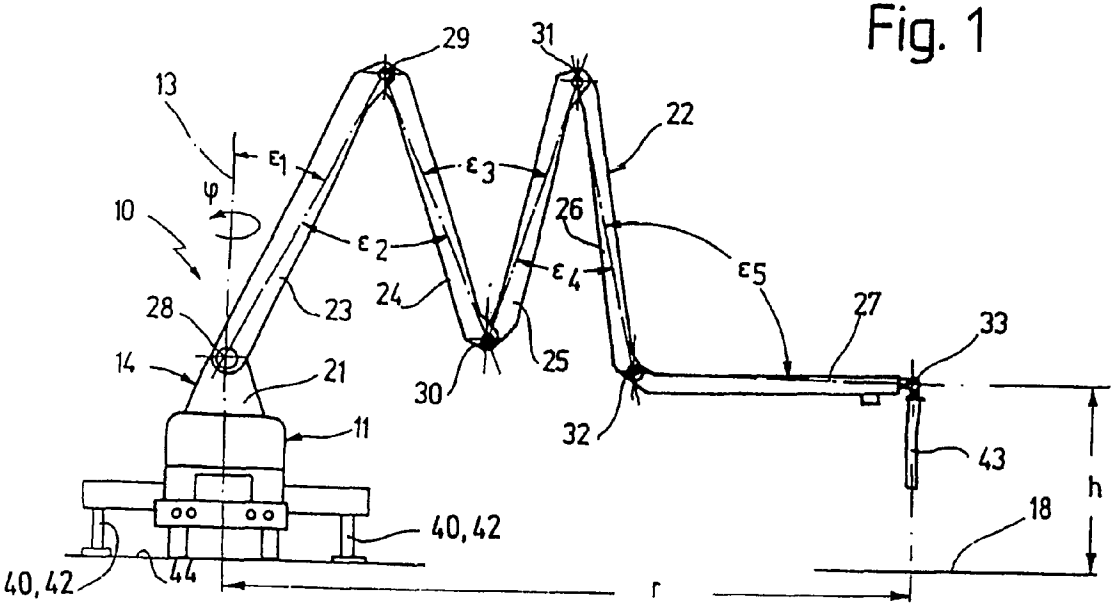

DEVICE FOR ACTUATING AN ARTICULATED MAST, ESPECIALLY FOR CONCRETE PUMPS

CROSS REFERENCE TO RELATED APPLICATION

This application is a national stage of PCT/EP02/01877 filed Feb. 22, 2002 and based upon DE 101 16 407.6 filed Apr. 2, 2001 under the International Convention.

BACKGROUND OF THE INVENTION

1. Field of the Invention

In the invention concerns a device for operating an articulated boom linked to a boom block, in particular a concrete placement boom, which boom block is rotatable via a preferably hydraulic-operated drive assembly and which articulated boom includes at least three boom segments, which segments are limitedly pivotable, each via respective preferably hydraulic actuated drive assemblies, relative to the boom block or relative to an adjacent boom segment about articulation axes which are parallel to each other and perpendicular to the axis of rotation of the boom block, with a control device for movement of the mast via individual drive assemblies and/or via final control elements supplied with energy or hydraulic pressure via a source, and with a remote control device communicating with one of the input stages of the control device, which remote control device includes a remote control element which is moveable back and forth by hand through a zero position in at least one main adjustment direction and thereby emits a remote control signal, as well as additional keys or selection elements putting out a remote control signal, wherein the control device includes a first computer assisted circuit arrangement processing the information from the remote control device, which is connected on the output side with the control inputs of the control elements.

2. Description of the Related Art

Mobile concrete pumps are conventionally operated by an operator, who uses a remote control device in order to carry out responsibilities of controlling the pump as well as positioning a terminal distribution hose connected to the tip of the articulated boom. The operator thereby has to control multiple rotational degrees of freedom of the articulated boom via the associated drive assemblies, moving the articulated boom in non-structured three-dimensional workspace while taking into consideration the boundary conditions of the construction site. In order to simplify the manipulation in this respect, a manipulation device has already been proposed (DE-A-4306127), in which the redundant articulated axes of the articulated boom, in any rotational position of the boom block, are controlled collectively via a single adjustment movement of the remote control element, independent of the rotation orientation of the boom block. At the same time the articulated boom carries out an extension and retraction movement which can be observed by the operator, wherein the height of the boom tip must in addition be kept constant. In order to make this possible, this control device includes a remote control element controllable, computer assisted, coordinate transformer for the drive assemblies. A basic precondition for such a manipulation of the articulated boom is a position controller or sensor, which includes among other things a sensor for the path or angle measurement of the individual boom arms, articulated axes and/or drive assemblies. Since it is not possible to completely preclude the possibility of technical interruptions in systems of this type, which would include mechanical as well as electronic and hydraulic components, there is a need for a safety monitoring component, which warns the operator and intervenes for safety in the operational sequence.

SUMMARY OF THE INVENTION

Beginning therewith, it is the task of the present invention to improve the known devices for operation of the articulated boom in such a manner that also in the case of computer assisted translation of remote control signals into movement sequences a safe operator-controllable movement sequence of the articulated boom is guaranteed.

For solving this task, the combination of characterizing features set forth in patent Claim 1 is proposed. Advantageous embodiments and further developments of the invention can be found in the dependent claims.

The inventive solution is based upon the recognition that with manipulation systems with partial automatic or automatic operating components preconditions must be met, which prevent the occurrence of faulty or erroneous automatic sequences. In order to accomplish this, it is proposed in accordance with the invention, that the control device includes an interruption element which, in the case that the at least one remote control element is in the zero position, interrupts the connection to the control inputs to the drive assemblies and/or the source of the energy or hydraulic pressure for the associated final control elements. The remote control elements are preferably control levers (joysticks) provided on the remote control device, while the interruption element corresponds to remote control signals generated by the zero position contacts of the control lever. If the zero positioning of the remote control element occurs by the release thereof, then the inventive means guarantee that an articulated boom movement can occur only then, when this is intentionally carried out by the operator. This applies as well in the case that the first remote control element includes a computer assisted position controller for the redundant articulated axes with associated path or angle providers and/or a computer assisted damping device with associated pressure receivers on the hydraulic drive assemblies. In both cases, the absence of the inventive interruption element could result, in the case of control failures, in undesired movements of the articulated boom which may impact safety. Since, in the case of each electronic control delays occur in the sense of hysteresis or lag, it is of advantage when the interruption element is controllable via a delay element. The delay element can be a delay relay. The time constant of the delay element should be adapted to the delay of the control loop. In the case of position control and damping of the boom segment the time constant is preferably smaller than 3 seconds and preferably lies in the range of 0.2 to 1.5 seconds.

During the pumping operation of a concrete pump the articulated boom is often not moved. The remote control element for the articulated boom movement is thus in the zero position, so that the drive assemblies are placed out of operation via the interruption element. Since on the other hand the articulated boom due to its construction is a system capable of elastic oscillation, and is capable of self oscillation, it is possible that due to the pulsating operation of the concrete pump and the therefrom resulting periodic surge and delay of the column of concrete being forced through the conveyance conduit, an undesired oscillation excitation of the articulated boom can result, which can be suppressed for example by active boom damping. The active boom damping requires a relative movement of the boom segment in opposition to the oscillation excitation. In order to make possible an active oscillation damping despite zero position of the remote control element, it is proposed in accordance with a preferred embodiment of the invention, that the control device includes a switch element, which upon operation bridges over the interruption element and/or its delay element. By this means the operator can introduce an active boom damping by manipulation of the switch (key or button).

Since the remote control device always includes respectively one switch for the switching on and switching off of the drive motor for the hydraulic pumps, there arises the possibility of providing the switch for the starting of the motor with a supplemental closing contact for bridging over of the interruption element and therewith the boom damping. The actual closing contact for this is located in the control device and is triggered via a switch element in the remote control device by an appropriate remote control signal.

In accordance with a further preferred embodiment of the invention the first switch assembly includes a computer assisted coordinate transformer, via which in a first main adjustment direction of one of the remote control elements the drive assembly of the redundant articulated axes of the boom segment with carrying out of a extension or retraction movement of the articulated boom in accordance with the magnitude of a predetermined path-pivot characteristic and in a second main control direction of the drive assembly of the mast boom are manipulable.

An increased operational reliability can be achieved thereby, that the control device includes a second circuit arrangement in connection with the input stage, which is connected on its output side with the control inputs of the control elements and thereby associates one of the drive assemblies with each of the main control directions of the remote control elements. Each preferred embodiment of the invention envisions thereby, that both circuit assemblies include output-side plug receptacles compatible with each other for the connection of a wiring harness leading to the control inputs of the control elements. In this manner is it possible by the simple plugging in and unplugging of the cable harness to operate the articulated boom either conventionally with manipulation of the individual boom segments via respectively one main control direction of the remote control element (second circuit arrangement) or via an intelligent computer assisted electronic (first circuit arrangement). Both circuit arrangements exhibit a common input stage, which for example may be a radio receiver for the reception of the remote control signals output by the remote control device. The input stage can be connected via a data bus, in particular a CAN-bus for transmission of the digitalized remote control signals with the first circuit arrangement.

For further increasing the operational safety and reliability it is proposed in accordance with a further embodiment of the invention that the drive assemblies are simplex hydraulic cylinders or hydraulic motors, that the supply units are supply valves for the supply of the common hydraulic pressure supply to the drive assemblies, which valves are operable via the remote control device by means of an electro-magnetic control element, and that the interruption element is provided in the supply line of the control element, preferably controllable via the delay element as a switch contact.

Preferably, the supply valve is a component of the simplex drive valve controllable via the remote control device for the selective control of the boom movement or a vehicle chassis supporting. The control arrangement thereby preferably includes an interruption element which, during switching over of the operating valve to chassis supporting, preferably via the delay element, interrupts the connections to the control inputs of the drive assemblies for boom movement and/or the supply unit for the energy and hydraulic pressure supply associated control elements. The control device further preferably includes an interruption element, which in the case of the zero positioning of the at least one remote control element or in the case of controlling of the boom movement interrupts the connection to the control inputs to the control elements of the drive assemblies for vehicle chassis supporting and/or one of the supply assemblies for the energy or hydraulic pressure supply associated control elements.

The inventive operating device is preferably used in a mobile concrete pump with articulated boom and with electronic control of the boom movement.

The remote control elements are preferably in the form of control levers with a radio-controlled remote control. In principle it is possible to employ the terminal distribution hose at the tip of the articulated boom as remote control element, wherein remote control signals generated by deflection of the terminal hose, for example using a tilt sensor, are translated into a coordinate provider of the first circuit arrangement into commands for articulated boom movement. The further remote control signal outputting switch or key elements, and in the this connection in particular the boom damping activating key element, can therein be incorporated in a remote control device provided at the terminal hose.

BRIEF DESCRIPTION OF THE DRAWINGS

In the following the invention will be described in greater detail on the basis of the illustrative embodiment shown schematically in the figures. There is shown FIG. 1 a side view of a mobile concrete pump with folded together articulated boom;

FIG. 2 the mobile concrete pump according to FIG. 1 with articulated boom in the working position.

DETAILED DESCRIPTION OF THE INVENTION

Figure 3:
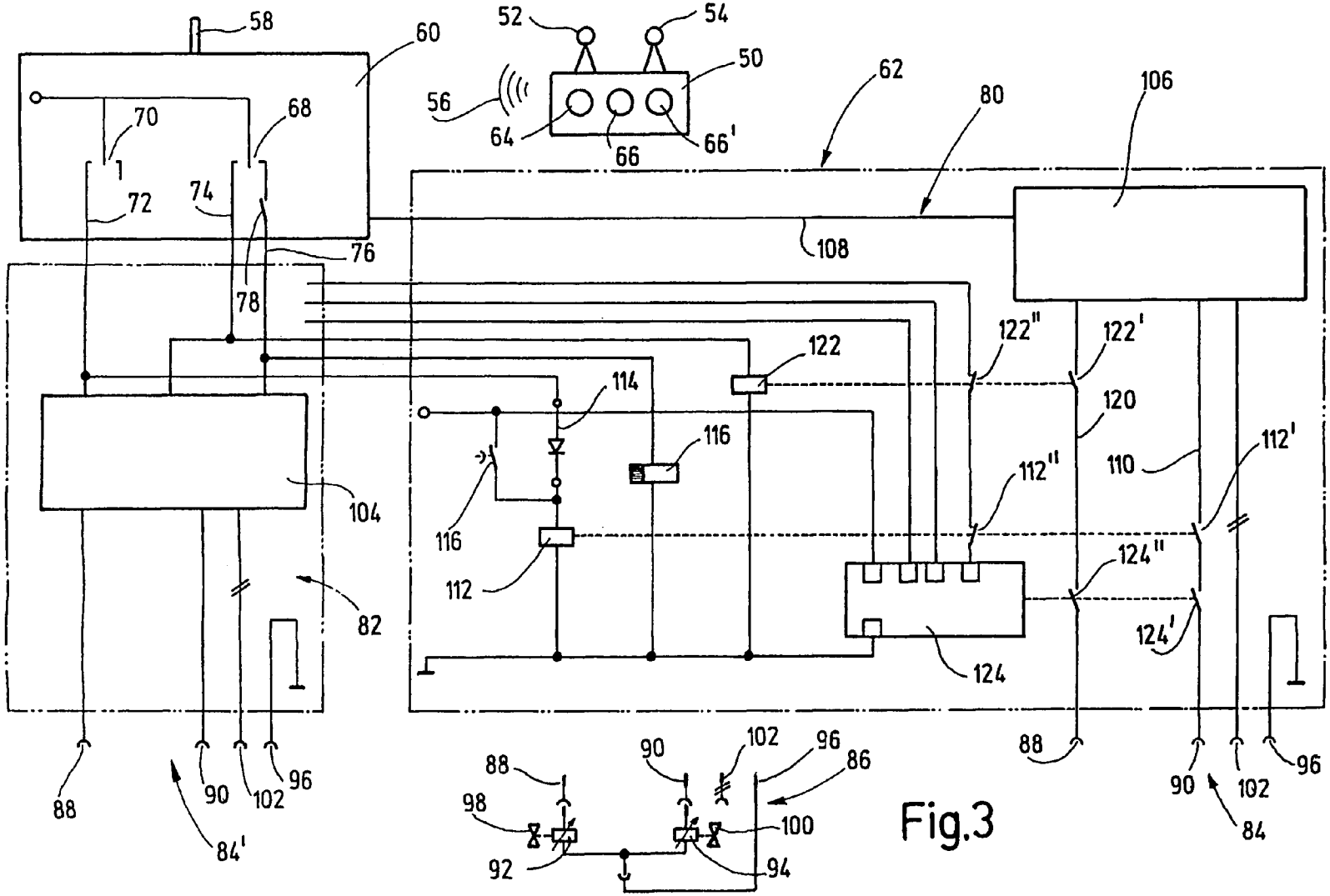
FIG. 3 a schematic flow diagram of a device for operating the articulated boom and the vehicle chassis support with safety circuitry.

The mobile concrete pump 10 includes a transport vehicle 11, a thick matter pump 12 in the form of, for example, a two cylinder pump as well as a concrete placement boom 14 rotatable about a vehicle-fixed vertical axis 13 as carrier for a concrete conveying conduit 16. Via the concrete conveying conduit 16 fluid concrete, which is continuously introduced into a hopper or supply container 17 during the concretizing process, is conveyed to a concretizing location 18 located away from the location of the vehicle 11.

The placement boom 14 is comprised of at least one boom block 21 rotatable about the vertical axes 13 via at least one hydraulic rotation drive 19 and an articulated boom 22 pivotable thereon, which is continuously adjustable to variable reaches r and height differentials h between the vehicle 11 and the concretizing location 18. The articulated boom 22 is comprised in the illustrated embodiment of five boom segments 23 through 27 connected with each other via articulated linkages, pivotable about axes 28 through 32 extending parallel to each other and at right angles to the vertical axis 13 of the boom block 21. The articulation angles $\epsilon_1$ through $\epsilon_5$ (FIG. 2) of the articulation linkages which create the articulation axes 28 through 32 and their relationship to each other are so coordinated relative to each other that the articulated boom 22 can be collapsed into the, as seen in FIG. 1, multiple-folded space-saving transport configuration upon the vehicle chassis 11. By an activation of the drive assemblies 34 through 38 which are individually associated to the individual articulated axes 28 through 32, the articulated boom 22 can be unfolded to reach various distances r and/or height differentials h between the concretizing location 18 and the parked position of the vehicle (FIG. 2).

The operator controls the movement of the boom using the wireless remote control device 50, via which the boom tip 33 with the terminal hose 43 is moved to the area to be concretized. The terminal hose 43 has a typical length of 3 to 4 meters and can, on the basis of its articulated hanging in the area of the boom tip 33 and on the basis of its inherent flexibility, allow its discharge end to be manipulated by a hose man into a desired position relative to the concretizing location 18.

The vehicle can be supported at the location of the vehicle on the ground 44 with lifting up of its wheels via a vehicle support strut comprised of forward located and rearward located support legs 40, 42. The support legs or struts 40, 42 are extendable, with the aid of not shown hydraulic drive assemblies on the vehicle, out of the transport position shown in FIG. 1 into the support position shown in FIG. 2. For this, the user also employs the same remote control device 50 which is also used for controlling the boom movement and the pumping operation.

The remote control device 50 includes, in the illustrated embodiment, two remote control elements 52, 54 in the form of control levers, which can be moved back and forth in three main control directions with output of remote control signals. The remote control signals are transmitted along a radio transmission path 56 to the vehicle-located radio receiver 58, which is integrated into the input stage of a controlled arrangement 62. The remote control device 50 includes a series of additional switch elements 64, 66, 66' which can be operated to transmit further radio signals to the radio receiver 58 along the radio transmission path 56. A first switch 64 is therein designed as selection switch for selective releasing of the support legs (line 74) and boom movement (line 76) with neutral center position, to which remote control signals the switch 68 responds to in the input stage 60 of the control device 62. The selection switch 70 located in the input stage 60 is responsive to the remote control signals of the key elements 66, 66', via which, upon actuation of the key elements 66 via line 72 the motor for the drive of the hydraulic pumps is started. In the zero position of the remote control elements 52, 54 respectively one remote control signal is triggered by the remote control device, which in the input stage generate the opening of the zero position contact 78 in the boom releasing line 76.

The control device 62 includes in the shown embodiment a first circuit arrangement 80 and a second circuit arrangement 82 which, independently from each other, are in condition to so connect the remote control signals coming into the radio receiver 58 and present in the input stage 60 in the form of electronic signals, that as desired the drive assemblies of the vehicle chassis support 40, 42 and the placement boom 14 as well as the concrete pump are electronically controlled. The two circuit assemblies 80, 82 exhibit for this purpose compatible plug places 84, 84', upon which selectively the wiring harness 86, provided with a compatible plug, can be plugged in, which wiring harness leads to the control inputs of the control elements for the drive assemblies. The receptacle locations 84, 84' are shown in simplified manner in FIG. 3. They show essentially the plug contacts 88, 90 for the control of the control element 92 for the releasing of the support struts and the control element 94 for the releasing of the boom with the associated measurement contact 96. Via the control elements 92, 94 the supply valves 98, 100 for the common pressure hydraulic fluid supply to the drive assemblies of the support legs 40, 42 or, as the case may be, the boom segments 23 through 27 and the rotation means 19, are electro-magnetically opened and closed. The supply valves 98, 100 are on the input side connected to the pressure line of a hydraulic pump and are components of a valve. Further indicated in FIG. 3 are the multiple contacts 102 for the control of the actuating elements of the drive assemblies 19, 34 through 38 for the movement of the boom.

The second circuit arrangement 82 includes a connecting circuit 104, in which the remote control signals converted into electrical signals at the input stage are transformed to output signals in a galvanic way, and are transmitted through the receptacle location 84' to the wiring harness 86. In particular, in the connecting circuit 104 the remote control signals generated via the control lever 50, 52 upon the release of the mast via the selection switch 68 are individually translated to the main adjustment directions of the control lever associated drive assemblies 19, 34 through 38 of the placement boom. The actuation of individual axis has the advantage that the individual boom segments can be brought individually into any desired position limited only by their degree of pivotability. Each axis of the articulated boom and the boom block is therein associated with one main adjustment direction of the remote control element, so that above all upon existence of more than three boom segments the actuation can be easily overseen or kept under control. The operator must continuously monitor both the axis being operated as well as the position of the terminal hose, in order to avoid the risk of uncontrolled movement at the terminal hose and therewith an endangerment of the construction site personnel.

With the switch or circuit arrangement 80 it is possible to substantially simplify the manual manipulation during the movement of the articulated boom in this respect. The circuit arrangement 80 includes for this purpose a computer assisted connecting circuit 106, with which the remote control signals transmitted via the data bus 108 from the input stage 60 are connected or associated with a predetermined algorithm and in this manner are output to the receptacle location 84 for controlling the actuating elements. The connecting circuit 106 includes among other things a computer assisted coordinate transformer, which includes among other things the characteristic features described in DE-A-4306127. Via the coordinate transformer remote control signals produced in a first main position of the remote control element 52, the drive assemblies 34 through 38 of the redundant articulated axes 28 through 32 of the boom segments 23 through 27 with carrying out of a extension or retraction movement of the articulated boom according to the magnitude of a predetermined path-tilt characteristic in a second main positioning direction of the drive assembly 19 of the boom block 21. In a third main positioning direction the drive assemblies 34 through 38 of the articulated axes 28 through 32 are independently operable with carrying out of an extension and tilt movement of the boom tip 33. Subsumed therein is that the path/tilt characteristic is modified in the coordinate transformer according to the magnitude of the weight dependent bending and torsional moments sensed at the individual boom segments. Since these connections result in a precise result only in the framework of a position control, supplemental path or angle measurements are necessary at the individual axis of the articulated segments, which are evaluated in the connecting circuit 106. The connecting circuit 106 can in addition be employed for mast oscillation damping. For this, there is needed a supplemental control with consideration of measured oscillation parameters.

The partially automated control processes in the connecting circuit 106 can be problematic in a manipulator to the extent that interruptions in the electronics or in the measuring system can lead to uncontrolled movement sequences. With the following safety precautions this problem is solved:

In the outlet line 110 leading to the boom contact 90 of the valve 98, 100 at the plug location 84 there is a relay contact 112' which is part of the relay 112 in the circuit arrangement 80. The relay 112 can be controlled via a contact in the key element 66 in the remote control device 62 via the two-way switch 70, the circuit 72 and the diode segment 114. The switch 66 thereby additionally assumes the function of an agreement switch, via which the relay contact 112' is closed. Besides this, the agreement relay 112 is arranged via the closing contact 116' of the delay relay 116, which is controllable behind the zero position contact 18 via the mast release line 76 coming from the input stage 60. The delay relay 116 decays with an adjustable or controllable time constant of 0.2 to 3 seconds, when the selection switch 68 is switched from mast release towards support strut release, or when the contact 78 is opened in the case of the zero positioning of the remote control element 52. On the basis of the verification relay 112 a boom operation is thus only possible when the selection switch 68 for releasing the boom is switched to line 76 and that the remote control element 52 relevant for movement of the mast is moved at least in one main direction out of the zero position. The delay during decay of the relay 116 is so adjusted, that the boom operation is not abruptly interrupted and a previously occurred controlled process in the connecting circuit 106 is completed. During non-movement of the articulated boom, for example during a pumping process, the relay contact 112' can be brought into its closed position via operation of the confirmation switch 66. Therewith it is possible to bring about an active oscillation damping via the connecting switch 106.

In the output line 120 for the support strut release in the valve 98 there is likewise a relay contact 122', which belongs to a relay 122. The relay 122 is controlled via support strut releasing line 74 coming from the input stage 60, when the selection switch 64, 68 is in its support strut releasing position. In this case the control element 92 is controlled via the output line 120 and via the supply valve 98 the drive assemblies of the support struts 40, 42 are acted upon with hydraulic oil.

The relays 112 and 122 have respectively one additional positive control contact 112", 122" in the activation line to the emergency off relay 124. These means serve for safety insofar as during a hanging up of the contacts 112', 122' the emergency-off relay 124 with its contacts 124', 124" can no longer be activated. Therein it is to be taken into consideration that the during each placing into operation of the control device 62 first the emergency off switch 124 must be activated so that the supply valve 98, 100 of the valve can be acted upon with voltage. This is a reset function, in which a horn is operated at the same time for acoustic confirmation.

In summary, the following can be concluded: The invention is concerned with a device for safety monitoring of an articulated boom 22, in particular a concrete placement boom, of which the boom segments 23 through 27 are controllable via a remote control device 50 and a control device 62 responsive to its remote control signals with utilization of a computer assisted circuit arrangement 80. The safety monitoring occurs thereby, that the control device 62 includes an interruption element 112, 112' which, when the remote control element 52 of the remote control device 50 is in the zero position, interrupts via a delay element 116 the connection to the control inputs of the actuators associated with the drive assemblies and/or the supply assemblies 98, 100 for supplying energy or hydraulic pressure to associated control elements 92, 94.

What is claimed is:

1. A device for operating an articulated boom (22) linked to a boom block (21), in particular a concrete placement boom, which boom block (21) is rotatable via a preferably hydraulic actuated drive assembly, and which articulated boom (22) includes at least three boom segments (23 through 27), which are each respectively limitedly pivotable relative to the boom block (21) or an adjacent boom segment about articulation axes (28 through 32), which axes are parallel to each other and perpendicular to the axis of rotation (13) of the boom block (21), by means of respectively one preferably hydraulic actuated drive assembly (34 through 38), with a control device (62) for movement of the boom with the aid of individual drive assemblies and/or a supply assembly (100) for supplying energy or hydraulic pressure to associated actuating elements (94), and with a remote control device (50) communicating with an input stage (60) of the control device (62), which includes at least one remote control element (52, 54) moveable back and forth by hand through a zero position in respectively at least one main adjustment direction and thereby generating a remote control signal, as well as additional remote control signal emitting switch elements (64, 66, 66'), wherein the control device (62) includes a computer assisted first circuit arrangement (80) receiving information from the remote control signal via the input stage (60), which is connected on the output side with control inputs (88, 90) of the actuating elements (92, 94), wherein the control device (62) includes an interruption element (112, 112') which, when the at least one remote control element (52) is in the zero position, interrupts the connection to the control inputs (90) of the actuators associated with the drive assembly and/or the supply unit (100) for providing the energy or hydraulic pressure to the associated control elements (94), wherein the interruption can be selectively bypassed by operation of a supplemental switch or key element (66).

2. A device according to claim 1, wherein the first circuit arrangement (80) includes a computer assisted position controller for the articulated axes (28 through 32) with associated path or angle providers and/or a computer assisted damping device with associated pressure probes on the hydraulic drive assemblies (34 through 38).

3. A device according to claim 1, wherein the interruption element (112, 112') is under the control of a delay element (116, 116').

4. A device according to claim 3, wherein the delay element is a delay relay (116, 116').

5. A device according to claim 3, wherein the delay element exhibits a time constant smaller than 3 seconds, preferably between 0.2 and 1.5 seconds.

6. A device according to claim 1, wherein the at least one remote control element (52, 54) is a control lever provided on the remote control device (50), and that the interruption element is responsive to the remote control signal generated by the at least one zero position contact of the control lever.

7. A device according to claim 1, wherein the first circuit arrangement (80) includes a computer assisted coordinate transformer, via which in a first main adjustment direction of the at least one remote control element (52) the drive assemblies (34 through 38) of the articulated axes (28 through 32) of the boom segments (23 through 27) carry out of an extension or retraction movement of the articulated boom (22) depending upon the value of a predetermined path tilt characteristic and in a second main adjustment direction the drive assembly (19) of the boom block (21) is operable.

8. A device according to claim 1, wherein the control device (62) includes a second circuit arrangement (82) connected with the input stage (60), which on the output side is connected with the control inputs of the control elements and thereby each main positioning direction of the remote control element (52, 54) is associated with one of the drive assemblies (19, 34 through 38).

9. A device according to claim 8, wherein both circuit arrangements (80, 82) exhibit, on the output side, connector receptacles (84, 84') compatible with each other for connecting a wiring harness leading to the control inputs (88, 90) of the control elements (92, 94).

10. A device according to claim 8, wherein the two circuit arrangements (80, 82) exhibit a common input stage (60).

11. A device according to claim 10, wherein the input stage (60) includes a radio receiver (58) for reception of the remote control signal transmitted by the remote control device (50).

12. A device according to claim 1, wherein the input stage (60) of the control device (62) is connected with the first circuit arrangement (80) via a preferably CAN-bus data bus for transmission of the data associated with the remote control signal.

13. A device according to claim 1, wherein the drive assemblies (19, 34 through 38) include a reciprocating hydraulic cylinder or hydraulic motor, that the supply assembly (98, 100) is a supply valve for the common hydraulic pressure fluid supply to the drive assemblies, that via the control device (62) is operable via an electromagnetic actuating element (92, 94) and that the interruption element (112, 112', 122, 122') is a switch contact (112', 122') provided in the supply line of the actuating element (92, 94), preferably controllable via a delay element (116).

14. A device according to claim 13, wherein the supply valve (98, 100) is a component of a simplex drive valve controllable via the control device (50) for the selective driving of the boom movement or driving vehicle supporting struts (40, 42).

15. A device according to claim 13, wherein the control device (62) includes an interruption element (98), which in the case of the zero positioning of the at least one remote control element (52, 54) or in the case of driving of the boom movement interrupts the connection to the control inputs of the actuating elements (92) associated with the drive assemblies and/or the supply valve (98) for supplying the energy or hydraulic pressure for supporting a vehicle chassis (40, 42).

* * * * *